US012409485B2

(12) United States Patent
Cho

(10) Patent No.: US 12,409,485 B2
(45) Date of Patent: Sep. 9, 2025

(54) MANUFACTURING DEVICE OF ROOF PANEL FOR VEHICLES

(71) Applicants: HYUNDAI MOTOR COMPANY, Seoul (KR); Kia Corporation, Seoul (KR)

(72) Inventor: JeongHee Cho, Ulsan (KR)

(73) Assignees: HYUNDAI MOTOR COMPANY, Seoul (KR); Kia Corporation, Seoul (KR)

( * ) Notice: Subject to any disclaimer, the term of this patent is extended or adjusted under 35 U.S.C. 154(b) by 351 days.

(21) Appl. No.: 18/144,389

(22) Filed: May 8, 2023

(65) Prior Publication Data

US 2024/0024941 A1 Jan. 25, 2024

(30) Foreign Application Priority Data

Jul. 21, 2022 (KR) ..... 10-2022-0090016

(51) Int. Cl.
*B21D 28/10* (2006.01)
*B21D 22/20* (2006.01)
*B21D 53/88* (2006.01)

(52) U.S. Cl.
CPC ..... *B21D 22/20* (2013.01); *B21D 28/10* (2013.01); *B21D 53/88* (2013.01)

(58) Field of Classification Search
CPC ..... B21D 22/02; B21D 22/06; B21D 22/20; B21D 22/26; B21D 35/001; B21D 53/88; B21D 28/26; B21D 28/10
See application file for complete search history.

(56) References Cited

U.S. PATENT DOCUMENTS

2017/0368594 A1* 12/2017 Dixit ..... B21D 28/02

FOREIGN PATENT DOCUMENTS

JP 2554768 B2 * 11/1996

* cited by examiner

*Primary Examiner* — Debra M Sullivan
(74) *Attorney, Agent, or Firm* — MORGAN, LEWIS & BOCKIUS LLP

(57) ABSTRACT

A manufacturing apparatus of a roof panel includes a first mold, a second mold including first trimming units provided in a second lower die and a second upper die to trim an edge portion of a first processed plate processed by the first mold, second trimming units to trim a sunroof hole in the first processed plate, first restriking units to form first undercut faces on both edge portions of the sunroof hole, and first cam forming units to form a hinge mounting portion and a third mold including flange forming units provided in a third lower die and a third upper die to form a down flange on an edge portion of the sunroof hole of a second processed plate processed by the second mold, and second restriking units provided in the third lower die and the third upper die to form a water receiving portion.

22 Claims, 20 Drawing Sheets

MANUFACTURING DEVICE OF ROOF PANEL FOR VEHICLES

CROSS-REFERENCE TO RELATED APPLICATION

The present application claims priority to Korean Patent Application No. 10-2022-0090016 filed on Jul. 21, 2022, the entire contents of which is incorporated herein for all purposes by this reference.

BACKGROUND OF THE PRESENT DISCLOSURE

Field of the Present Disclosure

The present disclosure relates to a manufacturing system of a vehicle body panel. More particularly, the present disclosure relates to a manufacturing device of a roof panel for a vehicle, which forms the roof panel to a predetermined shape in a sub-assembling line of a vehicle body.

Description of Related Art

In general, it is necessary to go through several molding processes to produce one complete vehicle body panel.

A vehicle body panel may be formed into a predetermined shape by drawing, trimming, flanging, restriking, and piercing processes of a panel material (e.g., blank).

For example, a roof panel for a vehicle is manufactured through four molds (e.g., a first mold, a second mold, a third mold, and a fourth mold) in the related art.

The first mold is used to perform the drawing process of forming the panel material into the predetermined shape. The second mold is used to perform the trimming process of cutting edges of the panel material. The third mold is used to perform a detailed trimming process and the restriking process of the panel material, and the fourth mold is used to perform the flanging process and the piercing process, etc., and finally mold the roof panel.

However, when the number of molds increases to perform the above processes, not only the manufacturing cost of the mold increases, but also a factory site used for manufacturing the mold also increases.

Furthermore, as the number of molds increases, a manufacturing period of the vehicle body panel also increases. Furthermore, when the number of molds increases, the time required for setting up the equipment in a mass production plate increases, which acts as an unfavorable factor for production management.

Accordingly, there is a demand for research and development of a method capable of simplifying the number of molds and the number of processes required for manufacturing the body panel.

The information disclosed in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a manufacturing apparatus of a roof panel for a vehicle capable of reducing the number of molds and the number of processes for forming the roof panel.

A manufacturing apparatus of a roof panel for a vehicle according to various exemplary embodiments of the present disclosure may include i) a first mold in which a blank holder and a lower drawing steel are provided in a first lower die, and an upper drawing steel corresponding to the lower drawing steel is provided in a first upper die, to draw a blank in a predetermined shape, ii) a second mold including first trimming units provided in a second lower die and a second upper die to trim an edge portion of a first processed plate processed by the first mold, second trimming units provided on the second lower die and the second upper die to trim a sunroof hole in a front portion of the first processed plate, first restriking units provided on the second lower die and the second upper die to form first undercut faces on first and second edge portions of the sunroof hole in a left and right direction, and first cam forming units provided on the second lower die and the second upper die to form a hinge mounting portion on a rear portion of the first processed plate, and iii) a third mold including flange forming units provided in a third lower die and a third upper die to form a down flange on an edge portion of the sunroof hole of a second processed plate processed by the second mold, and second restriking units provided in the third lower die and the third upper die to form a water receiving portion connected to the hinge mounting portion on a rear portion of the second processed plate.

A manufacturing apparatus of a roof panel for a vehicle according to various exemplary embodiments of the present disclosure may include i) a first mold in which a blank holder and a lower drawing steel are provided in a first lower die, and an upper drawing steel corresponding to the lower drawing steel is provided in a first upper die, to draw a blank in a predetermined shape, ii) a second mold including first trimming units provided in a second lower die and a second upper die to trim an edge portion of a first processed plate processed by the first mold, second trimming units provided on the second lower die and the second upper die to trim a sunroof hole in a front portion of the first processed plate, and first restriking units provided on the second lower die and the second upper die to form first undercut faces on first and second edge portions of the sunroof hole in a left and right direction, and iii) a third mold including flange forming units provided in a third lower die and a third upper die to form a down flange on an edge portion of the sunroof hole of a second processed plate processed by the second mold.

A manufacturing apparatus of a roof panel for a vehicle according to various exemplary embodiments of the present disclosure may include i) a first mold in which a blank holder and a lower drawing steel are provided in a first lower die, and an upper drawing steel corresponding to the lower drawing steel is provided in a first upper die, to draw a blank in a predetermined shape, ii) a second mold including first trimming units provided in a second lower die and a second upper die to trim an edge portion of a first processed plate processed by the first mold, and first cam forming units provided on the second lower die and the second upper die to form a hinge mounting portion on a rear portion of the first processed plate, and iii) a third mold including second restriking units provided in the third lower die and the third upper die to form a water receiving portion connected to the hinge mounting portion on a rear portion of a second processed plate processed by the second mold.

Furthermore, in the manufacturing apparatus of the roof panel for the vehicle according to various exemplary embodiments of the present disclosure, the first trimming units may form at least one molding mounting portion on each of first and second edge portions of the first processed plate in the left and right direction thereof.

Furthermore, in the manufacturing apparatus of the roof panel for the vehicle according to various exemplary embodiments of the present disclosure, the third mold may further include third trimming units provided on the third lower die and the third upper die to trim a rear end portion of the second processed plate; and a pair of cam trimming units provided on the third lower die and the third upper die to trim first and second sides of the rear end portion of the second processed plate, respectively.

Furthermore, in the manufacturing apparatus of the roof panel for the vehicle according to various exemplary embodiments of the present disclosure, the third mold may trim the rear end portion of the second processed plate through the third trimming units before forming the water receiving portion through the second restriking units.

Furthermore, in the manufacturing apparatus of the roof panel for the vehicle according to various exemplary embodiments of the present disclosure, the third mold may trim first and second sides of the rear end portion of the second processed plate, respectively, through the pair of cam trimming units after forming the water receiving portion through the second restriking units.

Furthermore, in the manufacturing apparatus of the roof panel for the vehicle according to various exemplary embodiments of the present disclosure, the third mold may further include second cam forming units provided on the third lower die and the third upper die to form a second undercut face on at least one corner of the down flange.

Furthermore, in the manufacturing apparatus of the roof panel for the vehicle according to various exemplary embodiments of the present disclosure, the third mold may further include third cam forming units provided on the third lower die and the third upper die, to form an up flange on the at least one molding mounting portion formed on the second processed plate.

Furthermore, in the manufacturing apparatus of the roof panel for the vehicle according to various exemplary embodiments of the present disclosure, the first trimming units may include a first lower trimming steel provided on the second lower die, and a first upper trimming steel provided on the second upper die in correspondence to the first lower trimming steel.

Furthermore, in the manufacturing apparatus of the roof panel for the vehicle according to various exemplary embodiments of the present disclosure, the second trimming units may include a second lower trimming steel connected to an internal edge portion of the first lower trimming steel, and a second upper trimming steel connected to an internal edge portion of the first upper trimming steel in correspondence to the second lower trimming steel, and including a pressing protrusion extending in a downward direction to support the first processed plate.

Furthermore, in the manufacturing apparatus of the roof panel for the vehicle according to various exemplary embodiments of the present disclosure, the first restriking units may include first lower restriking steels connected to the first lower trimming steel and the second lower trimming steel and including first undercut forming grooves formed therein; and first upper restriking steels connected to the first upper trimming steel and the second upper trimming steel and including first undercut forming protrusions corresponding to the first undercut forming grooves formed thereon.

Furthermore, in the manufacturing apparatus of the roof panel for the vehicle according to various exemplary embodiments of the present disclosure, the first cam forming units may include a swing cam rotatably provided on a die base mounted on the second lower die through a rotation center shaft in a front and rear direction and including a first lower cam forming steel mounted thereon, and a first cam slide slidably provided on the second upper die to be in cam contact with the swing cam, and including an upper cam forming steel corresponding to the first lower cam forming steel mounted thereon.

Furthermore, in the manufacturing apparatus of the roof panel for the vehicle according to various exemplary embodiments of the present disclosure, the rotation center shaft may be combined to an eccentric point biased to a rear side from the center portion of the swing cam.

Furthermore, in the manufacturing apparatus of the roof panel for the vehicle according to various exemplary embodiments of the present disclosure, the first cam forming units may further include a driving cylinder provided on the die base to be operable forwards and backwards in the front and rear direction, and a support block combined to an operation rod of the driving cylinder to support a front side of the swing cam.

Furthermore, in the manufacturing apparatus of the roof panel for the vehicle according to various exemplary embodiments of the present disclosure, the flange forming units may include a lower flange forming steel including separating blocks respectively disposed on first and second sides thereof in the left and right directions, and provided on the third lower die, and an upper flange forming steel provided in the third upper die in correspondence to the lower flange forming steel, and including through holes formed in first and second corners of the rear thereof.

Furthermore, in the manufacturing apparatus of the roof panel for the vehicle according to various exemplary embodiments of the present disclosure, each of the separating blocks may include a second undercut forming groove connected to each of the through holes.

Furthermore, in the manufacturing apparatus of the roof panel for the vehicle according to various exemplary embodiments of the present disclosure, the second cam forming units may include a second cam slide including a second lower cam forming steel including second undercut forming protrusions combined to the second undercut forming grooves through the through holes, the second cam slide being slidably provided on the third lower die, and first cam drives provided on the third lower die and the third upper die to slide and move the second cam slide.

Furthermore, in the manufacturing apparatus of the roof panel for the vehicle according to various exemplary embodiments of the present disclosure, the third cam forming units may include a third cam slide combined to each of the separating blocks and slidably provided on the third lower die, a plurality of seesaw cams fixed to first and second sides of the third lower die in the left and right direction, mounted on the third cam slide, and each including a third lower cam forming steel provided thereon, a second cam drive provided on the third upper die to be in cam contact with the third cam slide, and a plurality of third cam drives provided on the third upper die to be in cam contact with each of the seesaw cams.

Furthermore, in the manufacturing apparatus of the roof panel for the vehicle according to various exemplary embodiments of the present disclosure, the third mold may further include an upper pad movably provided on the third upper die in a vertical direction through a plurality of gas springs.

Furthermore, in the manufacturing apparatus of the roof panel for the vehicle according to various exemplary embodiments of the present disclosure, the third trimming units may include a third lower trimming steel provided on the third lower die, and a third upper trimming steel provided on the upper pad in correspondence to the third lower trimming steel.

Furthermore, in the manufacturing apparatus of the roof panel for the vehicle according to various exemplary embodiments of the present disclosure, the second restriking units may include a second lower restriking steel connected to the third lower trimming steel, and a second upper restriking steel provided on the upper pad with a height difference from the third upper trimming steel.

Furthermore, in the manufacturing apparatus of the roof panel for the vehicle according to various exemplary embodiments of the present disclosure, each of the pair of cam trimming units may include a fourth cam slide slidably provided on the third upper die and including a cam trimming steel provided thereon, and a fourth cam drive provided on the third lower die to be in cam contact with the fourth cam slide.

In various exemplary embodiments of the present disclosure, unlike the related art, because the roof panel may be manufactured through three molds, the number of molds and the number of processes may be reduced, and accordingly, the mold investment cost, the mold material cost, the processing cost, and the cost required for the production management, etc. may be reduced.

Furthermore, the effects obtainable or predicted by various exemplary embodiments of the present disclosure are disclosed directly or implicitly in the detailed description of various exemplary embodiments of the present disclosure. That is, various effects predicted according to various exemplary embodiments of the present disclosure will be disclosed in the detailed description to be described below.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
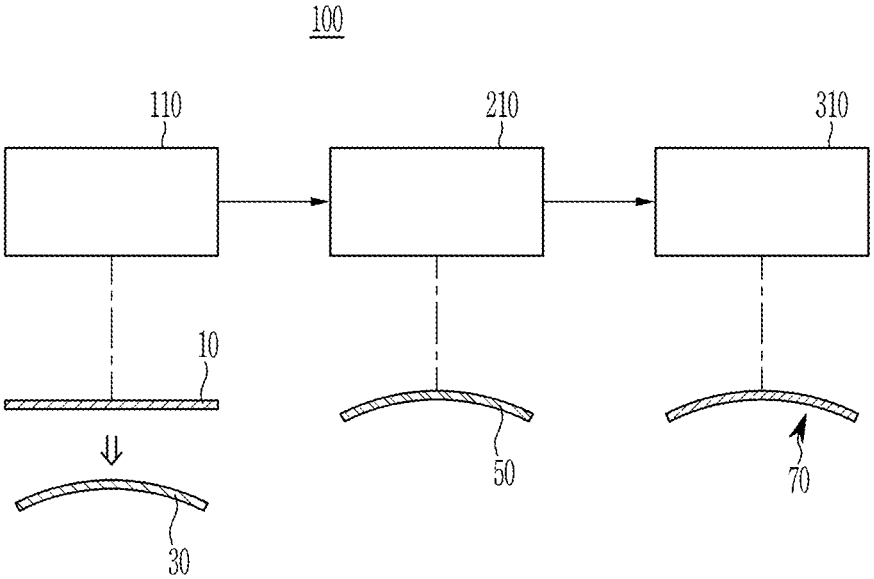
FIG. 1 is a block diagram schematically illustrating a manufacturing device of a roof panel for a vehicle according to various exemplary embodiments of the present disclosure.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to a same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Exemplary embodiments of the present disclosure will be described more fully hereinafter with reference to the accompanying drawings, in which embodiments of the present disclosure are shown. However, the present disclosure may be embodied in several different forms, and is not limited to the exemplary embodiment described herein.

The terms used herein are for describing specific embodiments, and are not intended to limit the present disclosure. As used herein, the singular forms are also intended to include the plural forms unless the context clearly dictates otherwise. As used herein, it should also be understood that the terms 'comprise' and/or 'comprising' indicate the presence of specified features, integers, steps, operations, elements and/or components, but do not exclude the presence or addition of one or more other features, integers, steps, etc. elements, operations, components, and/or groups thereof. As used herein, the term 'combined' indicates a physical relationship between two components in which the components are directly connected to each other or indirectly connected through one or more intervening components.

Furthermore, as used herein, the term 'and/or' includes any one or all combinations of one or more of associated listed items, and 'operably connected' or similar terms mean that at least two members are directly or indirectly connected to each other to transmit power. However, two operatively connected members do not always rotate at the same speed and in the same direction.

Furthermore, the terms "vehicle," "of a vehicle," "automobile," or other similar terms used herein generally may include passenger automobiles including a passenger vehicle including a sports vehicle, a sports utility vehicle (SUV), a bus, a truck, and various commercial vehicles, and may include a hybrid vehicle, an electric vehicle, a hybrid electric vehicle, a hydrogen power vehicle, and other alternative fuel vehicles (e.g., fuels derived from resources other than petroleum).

Hereinafter, embodiments of the present disclosure will be described in detail with reference to the accompanying drawings.

FIG. 1 is a block diagram schematically illustrating a manufacturing device of a roof panel for a vehicle according to various exemplary embodiments of the present disclosure.

Referring to FIG. 1, a manufacturing device 100 of the roof panel for the vehicle according to various exemplary embodiments of the present disclosure may be applied to a press system that forms a vehicle body panel into a predetermined shape in a vehicle body sub-assembly line.

The press system may include a drawing process, a trimming process, a flanging process, a restriking process, and a piercing process.

In one example, the manufacturing device 100 of the roof panel for the vehicle according to various exemplary embodiments of the present disclosure may form a roof panel 70 to which a sunroof hole is applied into the predetermined shape through the above-described processes.

In another example, the manufacturing device 100 of the roof panel for the vehicle according to various exemplary embodiments of the present disclosure may form the roof panel 70 to which a tailgate may be hinged into the predetermined shape through the above-described processes.

Furthermore, the manufacturing device 100 of the roof panel for the vehicle according to various exemplary embodiments of the present disclosure may also form the roof panel 70 to which the sunroof hole and a hinge mounting structure of the tailgate are applied into the predetermined shape through the above-described processes.

However, hereinafter, an example of forming the roof panel 70 to which the sunroof hole and the hinge mounting structure of the tailgate are applied into the predetermined shape will be described.

In the present specification, a longitudinal direction of the roof panel 70 may be defined as a front and rear direction (e.g., a vehicle body longitudinal direction), and a width direction (e.g., a width direction of the vehicle) of the roof panel 70 may be defined as a left and right direction thereof.

And, in the present specification, the 'upper end portion', 'upper portion', 'upper end' or 'upper surface' of the constituent element indicates the end portion, part, end, or surface of the constituent element at a relatively upper side in the drawing, and the 'lower end portion', 'lower portion', 'lower end' or 'lower surface' of the constituent element indicates the end portion, part, end, or surface of the constituent element at a relatively lower side in the drawing.

Furthermore, in the present specification, an end (e.g., one side end or another side end, etc.) of the constituent element indicates an end point of the constituent element in any one direction, and an end portion (e.g., one side end portion or another one side end portion, etc.) of the constituent element indicates a certain part of the constituent element including an end point thereof.

The manufacturing device 100 of the roof panel for the vehicle according to various exemplary embodiments of the present disclosure includes a structure configured for reducing the number of molds and the number of processes required for forming the roof panel 70.

To the present end, the manufacturing device 100 of the roof panel for the vehicle according to various exemplary embodiments of the present disclosure includes a first mold 110, a second mold 210, and a third mold 310.

In various exemplary embodiments of the present disclosure, the first mold 110 may form a blank 10 as a panel material into a predetermined shape. The second mold 210 may form a first processed plate 30 processed by the first mold 110 into a different shape, and the third mold 310 may form a second processed plate 50 processed by the second mold 210 into the final roof panel 70.

The configurations and operations of the first mold 110, the second mold 210, and the third mold 310 will be described in more detail below.

Figure 2:
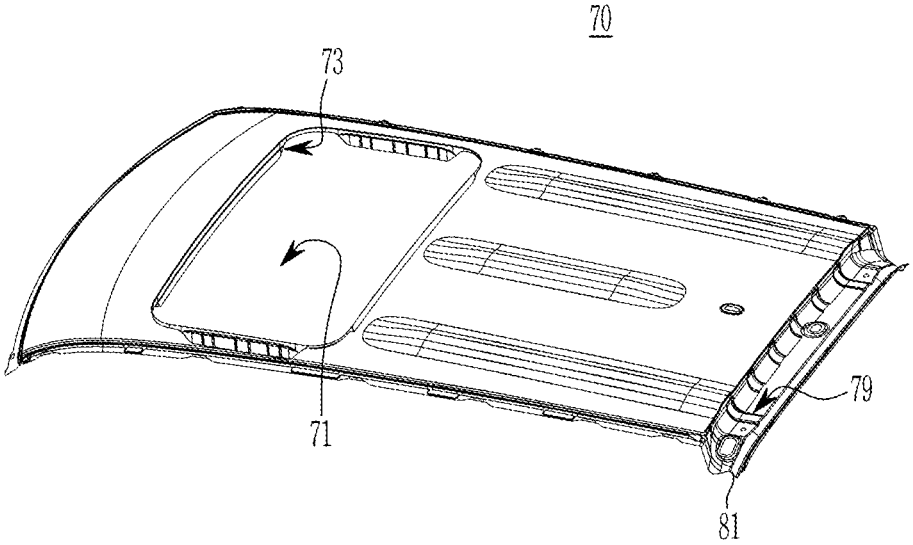
FIG. 2 and FIG. 3 are views exemplarily illustrating examples of a roof panel manufactured by a manufacturing device of a roof panel for a vehicle according to various exemplary embodiments of the present disclosure.
Figure 3:
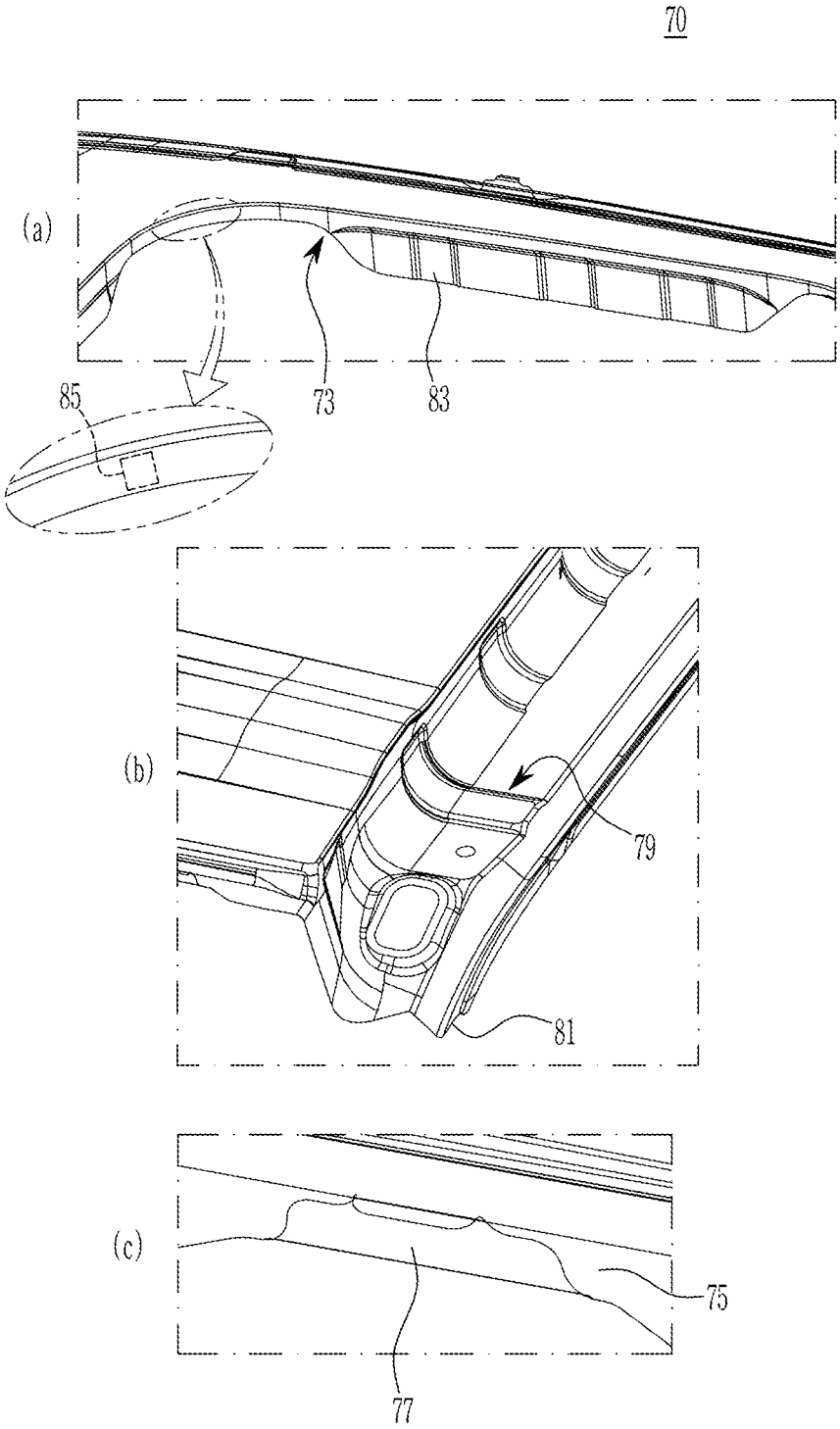

Meanwhile, in one example, the roof panel 70 manufactured by the manufacturing device 100 of the roof panel for the vehicle according to various exemplary embodiments of the present disclosure includes a sunroof hole 71 formed in the front portion as shown in FIG. 2 and FIG. 3.

Furthermore, the roof panel 70 includes a down flange 73 extending in a downward direction from an edge portion of the sunroof hole 71 and at least one molding mounting portion 75 respectively formed on both edge portions of the sunroof hole 71 in left and right direction thereof.

Here, the sunroof hole 71 and the down flange 73 are configured to mount a sunroof glass. Furthermore, the at least one molding mounting portion 75 is configured to mount a roof side molding.

Furthermore, the at least one molding mounting portion 75 includes an up flange 77. Furthermore, the roof panel 70 includes a hinge mounting portion 79 formed on the rear portion and a water receiving portion 81 connected to the hinge mounting portion 79.

In the above, the up flange 77 is configured to mount a clip for fixing roof side molding to the at least one molding mounting portion 75. The hinge mounting portion 79 is configured to mount a hinge of a tailgate, and the water receiving portion 81 is configured to induce water flowing along a glass surface of a sunroof glass to the side of the vehicle.

Furthermore, the down flange 73 as described above includes first undercut faces 83 and second undercut faces 85 for fixing the sunroof glass.

Here, the first undercut faces 83 may be formed in the down flange 73 at positions corresponding to both edge portions of the sunroof hole 71 in the front and rear direction thereof. Furthermore, the second undercut faces 85 may be formed on at least one corner of the down flange 73. In one example, the second undercut faces 85 may be formed at the corners of both rear sides of the down flange 73, respectively.

Hereinafter, the configurations of the first mold 110, the second mold 210, and the third mold 310 as described above will be described in detail with reference to FIG. 1, FIG. 2, and FIG. 3 and the accompanying drawings.

Figure 4:
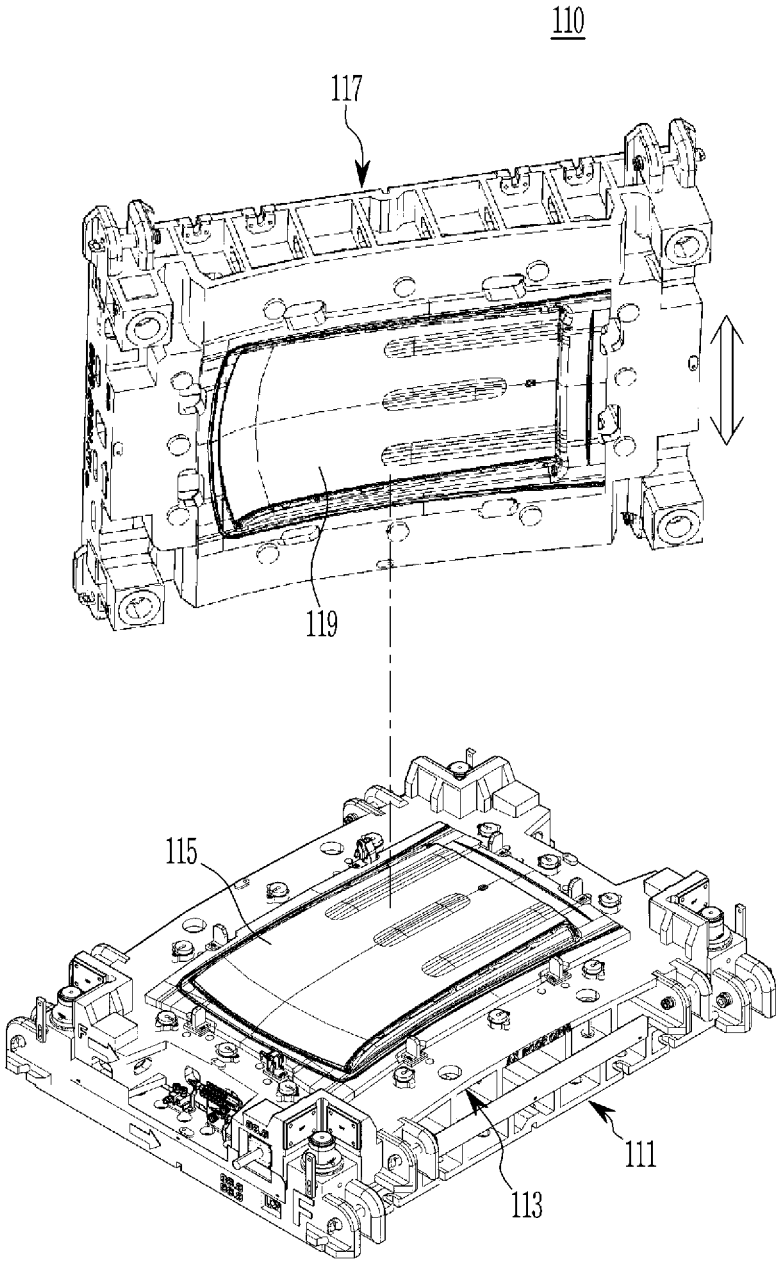
FIG. 4 is a view exemplarily illustrating a first mold applied to a manufacturing device of a roof panel for a vehicle according to various exemplary embodiments of the present disclosure.

FIG. 4 is a view exemplarily illustrating a first mold applied to a manufacturing device of a roof panel for a vehicle according to various exemplary embodiments of the present disclosure.

Figure 5:
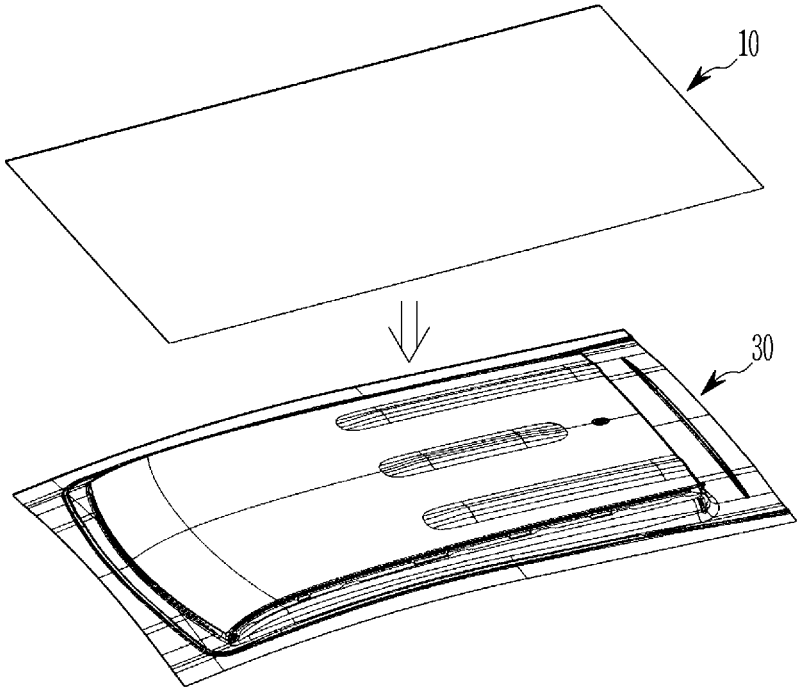
FIG. 5 is a view exemplarily illustrating a first processed plate formed by a first mold applied to a manufacturing device of a roof panel for a vehicle according to various exemplary embodiments of the present disclosure.

Referring to FIGS. 1 and 4, in various exemplary embodiments of the present disclosure, the first mold 110 is configured to draw the blank 10 cut to a predetermined size into a predetermined shape. As shown in FIG. 5, the first mold 110 may draw and form the blank 10 into a first processed plate 30 including a predetermined shape.

The first mold 110 includes a first lower die 111, a blank holder 113, a lower drawing steel 115, a first upper die 117, and an upper drawing steel 119.

The first lower die 111 is fixed to the floor of a process workshop. The blank holder 113 is configured to support the edge portion of the blank 10 (hereinafter see FIG. 5). The blank holder 113 is provided on the first lower die 111 to be movable in a vertical direction thereof. The blank holder 113 may be moved up and down through a plurality of cushion springs known to a person of an ordinary skill in the art. The lower drawing steel 115 (also referred to as 'punch' by a person of an ordinary skill in the art) is configured to form a lower surface of the first processed plate 30. The lower drawing steel 115 is fixed to the upper portion of the first lower die 111, and is disposed inside the edge portion of the blank holder 113.

The first upper die 117 is provided to be movable in the vertical direction in correspondence to the first lower die 111. The first upper die 117 may reciprocate in the vertical direction by a hydraulic pressure cylinder device known to a person of an ordinary skill in the art. The upper drawing steel 119 is configured to form an upper surface of the first processed plate 30. The upper drawing steel 119 is fixed to the lower portion of the first upper die 117 in correspondence to the lower drawing steel 115.

Figure 6:
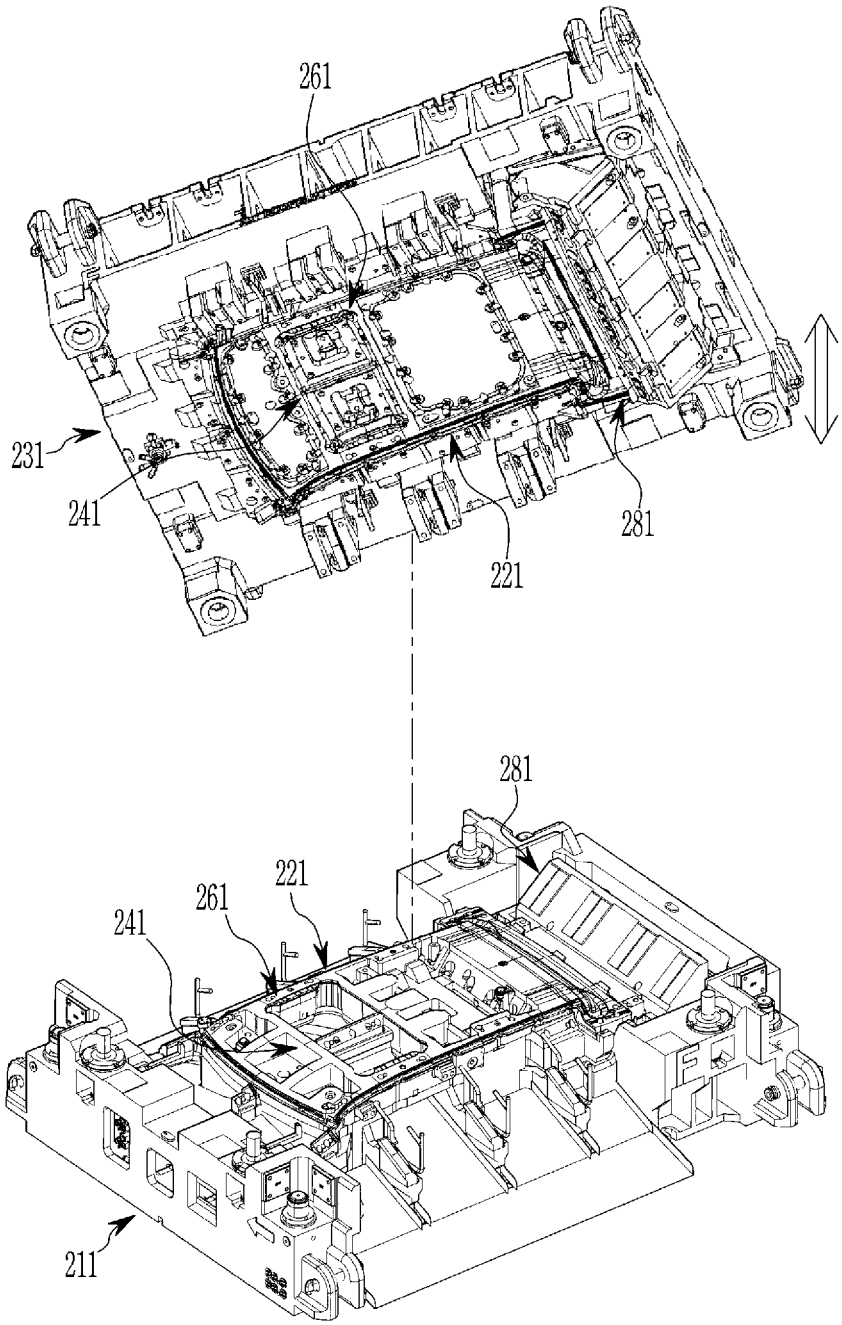
FIG. 6 is a view exemplarily illustrating a second mold applied to a manufacturing device of a roof panel for a vehicle according to various exemplary embodiments of the present disclosure.

FIG. 6 is a view exemplarily illustrating a second mold applied to a manufacturing device of a roof panel for a vehicle according to various exemplary embodiments of the present disclosure.

Referring to FIGS. 1 and 6, in various exemplary embodiments of the present disclosure, the second mold 210 is configured to form the first processed plate 30 (hereinafter see FIG. 5) processed by the first mold 110 into a predetermined shape.

Figure 7:
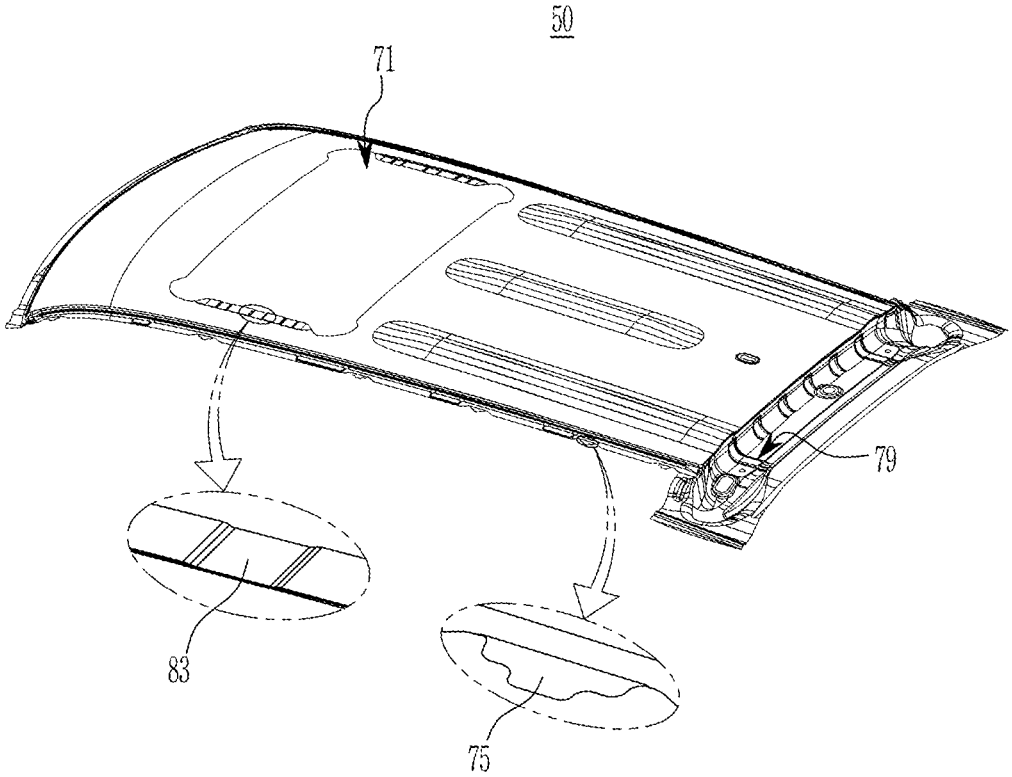
FIG. 7 is a view exemplarily illustrating a second processed plate formed by a second mold applied to a manufacturing device of a roof panel for a vehicle according to various exemplary embodiments of the present disclosure.

The second mold 210 may form the first processed plate 30 into a second processed plate 50 of the predetermined shape as shown in FIG. 7 by trimming, restriking, and cam forming the first processed plate 30.

The second mold 210 includes a second lower die 211, a second upper die 231, a first trimming unit 221, a second trimming unit 241, first restriking units 261, and first cam forming units 281.

The second lower die 211 is fixed to the floor of the process workshop. The second upper die 231 is provided to be movable in the vertical direction in correspondence to the second lower die 211. The second upper die 231 may reciprocate in the vertical direction by a hydraulic pressure cylinder device known to a person of an ordinary skill in the art.

In various exemplary embodiments of the present disclosure, the first trimming unit 221 is configured to trim the edge portion of the first processed plate 30 processed by the first mold 110. The first trimming unit 221 may entirely trim the edge portion of the front portion of the first processed plate 30 and both edge portions thereof in the left and right direction thereof. Furthermore, the first trimming unit 221 may form at least one molding mounting portion 75 as shown in FIG. 7 at each of both edge portions of the first processed plate 30 in the left and right direction thereof. The first trimming unit 221 is provided on the second lower die 211 and the second upper die 231.

As shown in FIG. 6, FIG. 7, FIG. 8, and FIG. 9, the first trimming unit 221 includes a first lower trimming steel 223 and a first upper trimming steel 225.

Figure 8:
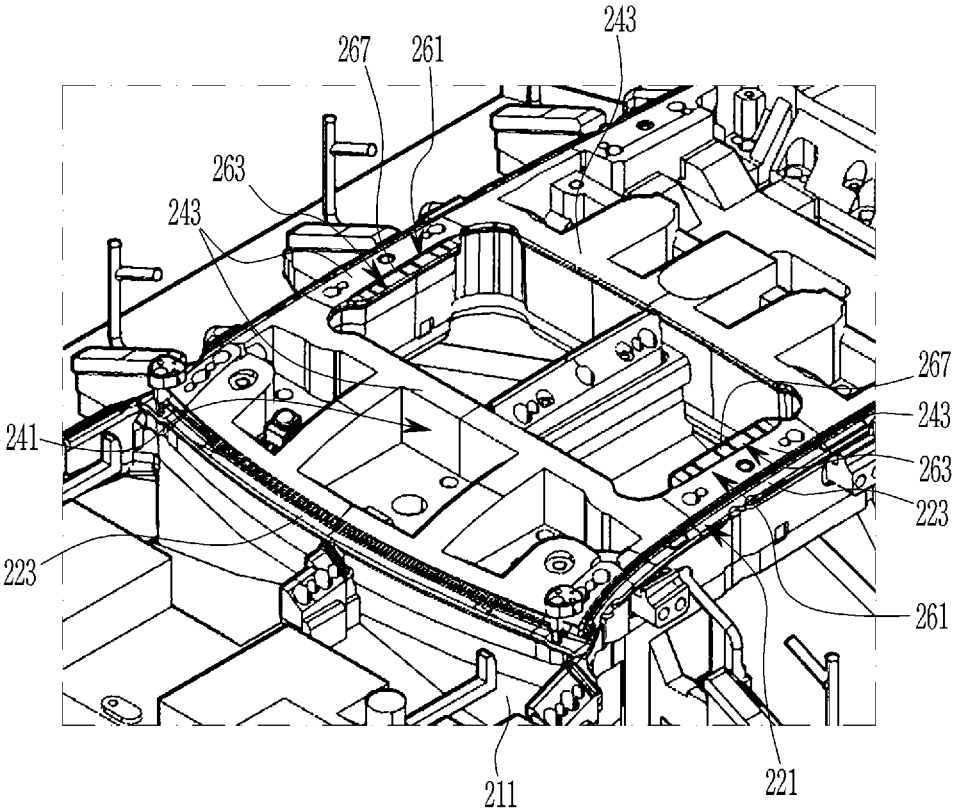
FIG. 8 and FIG. 9 are views exemplarily illustrating a first trimming unit, a second trimming unit, and a first restriking unit of a second mold applied to a manufacturing device of a roof panel for a vehicle according to various exemplary embodiments of the present disclosure.

As shown in FIG. 8, the first lower trimming steel 223 is provided on an upper portion of the second lower die 211. The first lower trimming steel 223 is configured to support the edge portion of the front portion of the first processed plate 30 and both edge portions in the left and right direction thereof.

Figure 9:
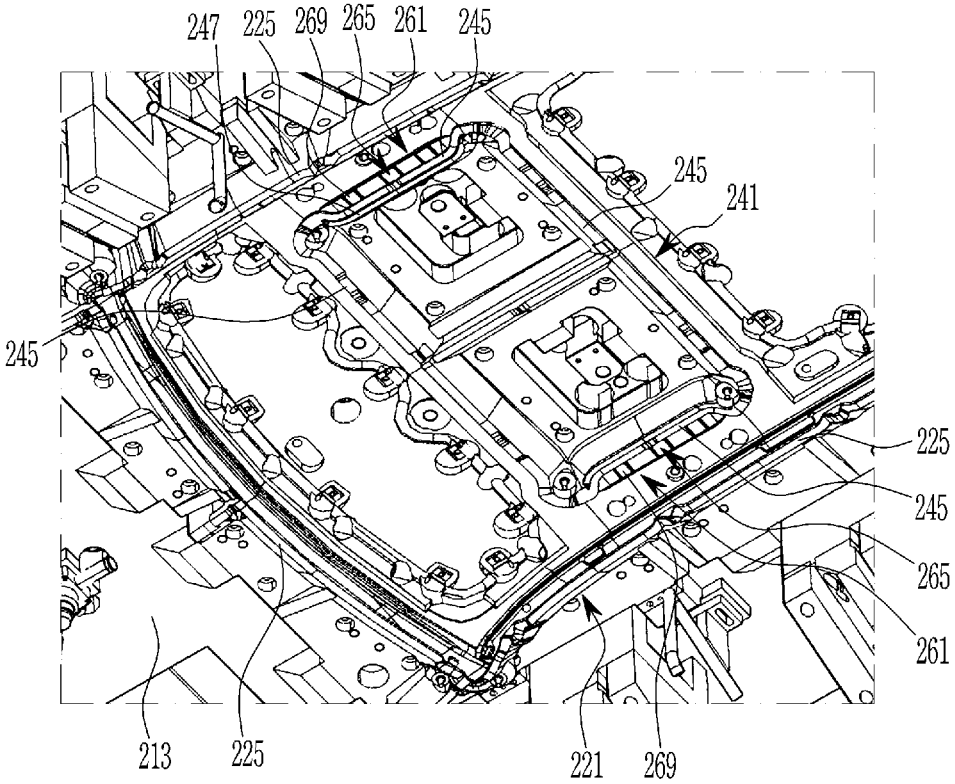

As shown in FIG. 9, the first upper trimming steel 225 is provided on a lower portion of the second upper die 231 in correspondence to the first lower trimming steel 223. The first upper trimming steel 225 is configured to cut the edge portion of the front portion of the first processed plate 30 placed on the first lower trimming steel 223 and both edge portions in the left and right direction thereof.

Referring to FIG. 6, FIG. 7, FIG. 8, and FIG. 9, in various exemplary embodiments of the present disclosure, the second trimming unit 241 is configured to trim the sunroof hole 71 as shown in FIG. 7 in the front portion of the first processed plate 30. In one example, the sunroof hole 71 may be a substantially quadrangle hole. The second trimming unit 241 is provided on the second lower die 211 and the second upper die 231.

The second trimming unit 241 includes a second lower trimming steel 243 and a second upper trimming steel 245.

As shown in FIG. 8, the second lower trimming steel 243 is provided on an upper portion of the second lower die 211. The second lower trimming steel 243 is configured to support the front portion of the first processed plate 30. The second lower trimming steel 243 is connected to an internal edge portion of the first lower trimming steel 223.

As shown in FIG. 9, the second upper trimming steel 245 is provided on a lower portion of the second upper die 231 in correspondence to the second lower trimming steel 243. The second upper trimming steel 245 is configured to cut the front portion of the first processed plate 30 placed on the second lower trimming steel 243 in the shape of the sunroof hole 71.

The second upper trimming steel 245 is connected to an internal edge portion of the first upper trimming steel 225 in correspondence to the second lower trimming steel 243. Furthermore, the second upper trimming steel 245 includes a pressing protrusion 247 extending in a downward direction thereof. The pressing protrusion 247 is configured to support and presses the first processed plate 30.

Referring to FIG. 6, FIG. 7, FIG. 8, and FIG. 9, in various exemplary embodiments of the present disclosure, the first restriking units 261 are configured to respectively form the first undercut faces 83 at both edge portions of the sunroof hole 71 in the left and right direction as shown in FIG. 7. The first restriking units 261 are respectively provided on the second lower die 211 and the second upper die 231.

The first restriking units 261 include first lower restriking steels 263 and first upper restriking steels 265.

As shown in FIG. 8, the first lower restriking steels 263 are provided on an upper portion of the second lower die 211. The first lower restriking steels 263 are connected to the first lower trimming steel 223 and the second lower trimming steel 243. The first lower restriking steels 263 are configured to support both edge portions of the sunroof hole 71 in the left and right direction thereof. The first lower restriking steels 263 include first undercut forming grooves 267 extending in the downward direction from the upper surface.

As shown in FIG. 9, the first upper restriking steels 265 are provided on a lower portion of the second upper die 231 in correspondence to the first lower restriking steels 263. The first upper restriking steels 265 are connected to the first upper trimming steel 225 and the second upper trimming steel 245. The first upper restriking steels 265 include first undercut forming protrusions 269 extending (e.g., protruding) in an upward direction in correspondence to the first undercut forming grooves 267.

Referring to FIG. 6, in various exemplary embodiments of the present disclosure, the first cam forming units 281 are configured to form the hinge mounting portion 79 as shown in FIG. 7 on the rear portion of the first processed plate 30 in a cam forming method. The first cam forming units 281 are provided on the second lower die 211 and the second upper die 231.

Figure 10:
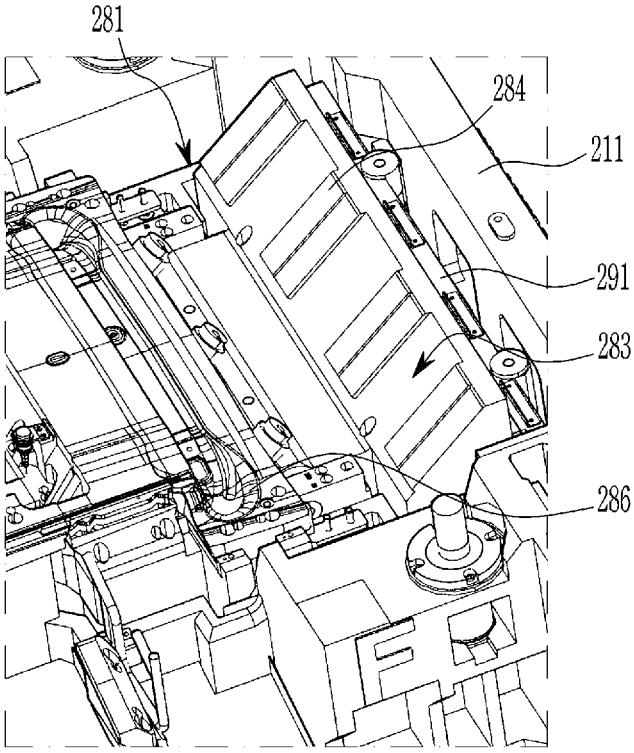
FIG. 10, FIG. 11, and FIG. 12 are views exemplarily illustrating first cam forming units of a second mold applied to a manufacturing device of a roof panel for a vehicle according to various exemplary embodiments of the present disclosure.
Figure 11:
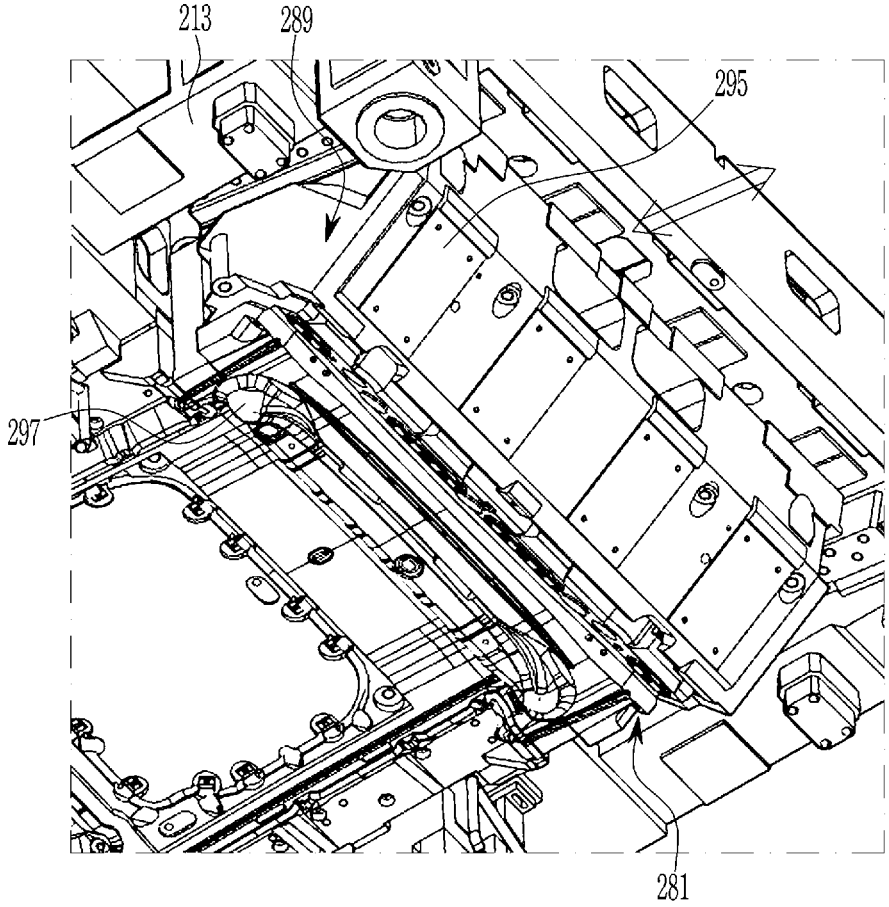
Figure 12:
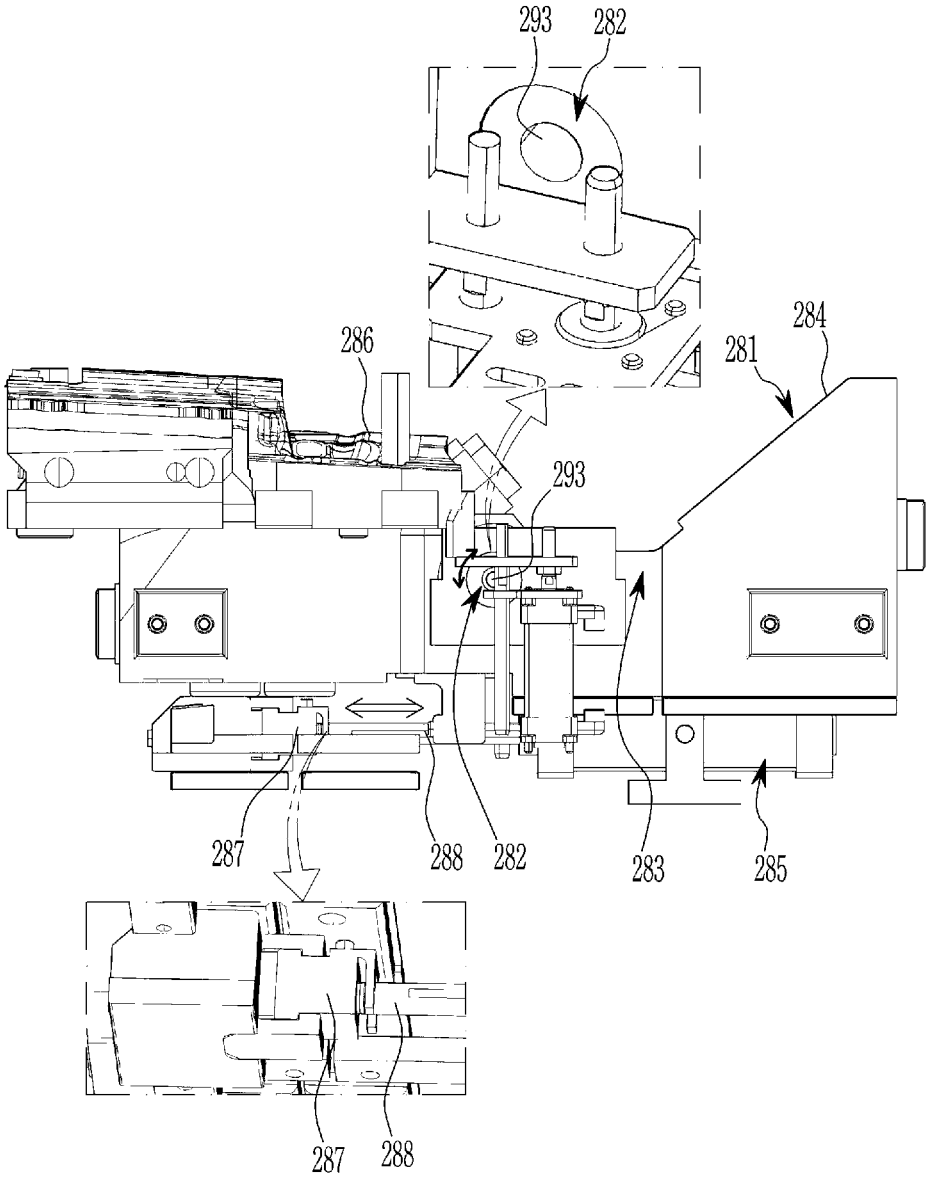

Referring to FIG. 10, FIG. 11, and FIG. 12 together with FIG. 6, the first cam forming units 281 include a swing cam 283, a driving cylinder 285, a support block 287, and a first cam slide 289.

The swing cam 283 is rotatably provided on a die base 291 mounted on the upper portion of the second lower die 211 in the front and rear direction through a rotation center shaft 293.

Here, the rotation center shaft 293 is combined to an eccentric point 282 (e.g., a rotation center point) which is biased to the rear side from the center portion of the swing cam 283. That is, the swing cam 283 may be rotated in the front and rear directions through the rotation center shaft 293 combined to the eccentric point 282.

The swing cam 283 includes at least one first cam face 284 formed to be inclined from the rear to the front. Furthermore, a first lower cam forming steel 286 is mounted on the swing cam 283. The first lower cam forming steel 286 is configured to form a lower surface of the hinge mounting portion 79.

The driving cylinder 285 is provided on the die base 291 to be operable forwards and backwards in correspondence to the swing cam 283. The driving cylinder 285 may be fixed to the floor of the die base 291 with the swing cam 283 thereon. In one example, the driving cylinder 285 includes an operation rod 288 which is moved forwards and backwards by hydraulic pressure.

The support block 287 is configured to support the lower portion of the front side of the swing cam 283. The support block 287 is combined to the operation rod 288 of the driving cylinder 285.

Here, when the operation rod 288 is moved backward by operation of the driving cylinder 285, the support block 287 is moved backward, and the swing cam 283 may be rotated forward through the rotation center shaft 293, and when the operation rod 288 moves forward by operation of the driving cylinder 285, the support block 287 is moved forward, and rotation of the swing cam 283 may be prevented.

The first cam slide 289 is slidably provided on the lower portion of the second upper die 231 in the front and rear directions to be in cam contact with the swing cam 283. The first cam slide 289 includes at least one second cam face 295 which is in cam contact with the at least one first cam face 284 of the swing cam 283.

And, an upper cam forming steel 297 corresponding to the first lower cam forming steel 286 of the swing cam 283 is mounted on the first cam slide 289. The upper cam forming steel 297 is configured to form the upper surface of the hinge mounting portion 79.

Figure 13:
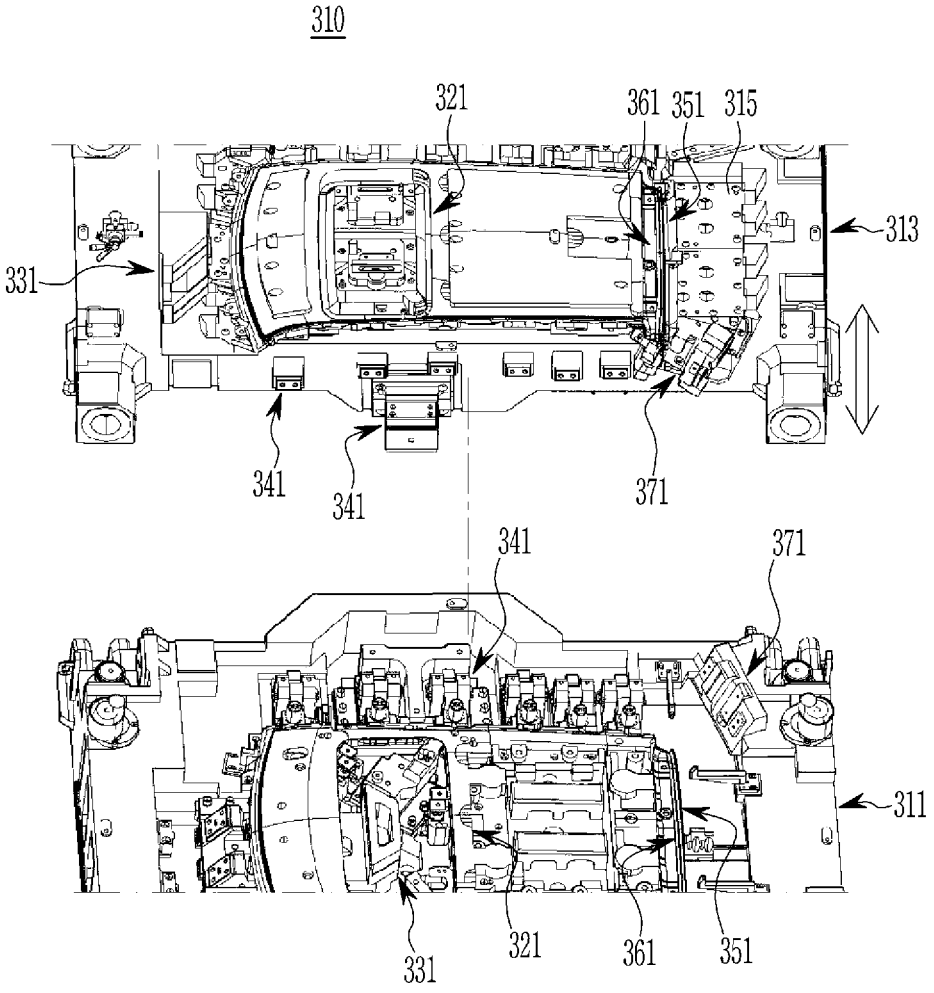
FIG. 13 is a view exemplarily illustrating a third mold applied to a manufacturing device of a roof panel for a vehicle according to various exemplary embodiments of the present disclosure.

FIG. 13 is a view exemplarily illustrating a third mold applied to a manufacturing device of a roof panel for a vehicle according to various exemplary embodiments of the present disclosure.

Referring to FIGS. 1 and 13, in various exemplary embodiments of the present disclosure, the third mold 310 is configured to form the second processed plate 50 (hereinafter see FIG. 7) processed by the second mold 210 into the predetermined shape.

The third mold 310 flange forms, cam forms, trims, and restriks the second processed plate 50, and forms the second processed plate 50 into the final roof panel 70 as shown in FIG. 2 and FIG. 3.

The third mold 310 includes a third lower die 311, a third upper die 313, a flange forming unit 321, a second cam forming unit 331, a third cam forming unit 341, a third trimming units 351, a second restriking unit 361, and a pair of cam trimming units 371.

The third lower die 311 is fixed to the floor of a process workshop. The third upper die 313 is provided to be movable in the vertical direction in correspondence to the third lower die 311. The third upper die 313 may reciprocate in the vertical direction by a hydraulic pressure cylinder known to a person of an ordinary skill in the art.

In various exemplary embodiments of the present disclosure, the flange forming unit 321 is configured to form the down flange 73 as shown in FIG. 2 and FIG. 3 on the edge portion of the sunroof hole 71 (hereinafter see FIG. 7) of the second processed plate 50 processed by the second mold 210. The flange forming unit 321 is provided on the third lower die 311 and the third upper die 313.

Figure 14:
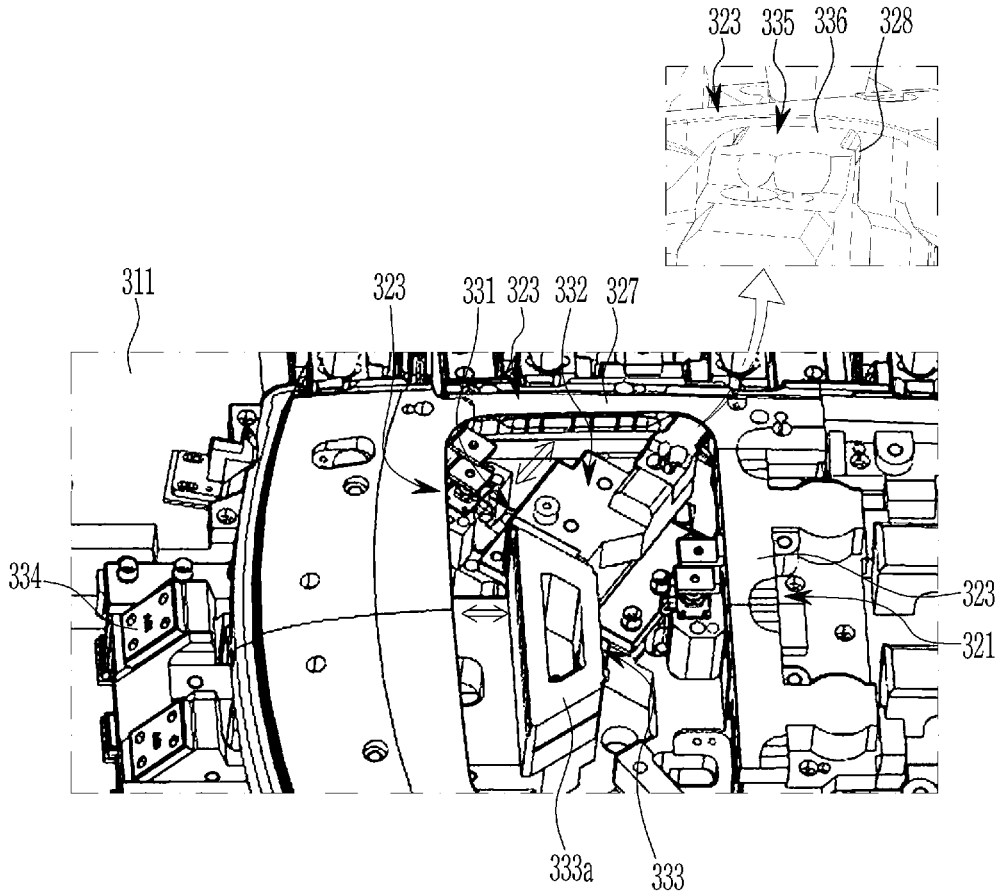
FIG. 14, and FIG. 15 are views exemplarily illustrating a flange forming unit and a second cam forming unit of a third mold applied to a manufacturing device of a roof panel for a vehicle according to various exemplary embodiments of the present disclosure.
Figure 15:
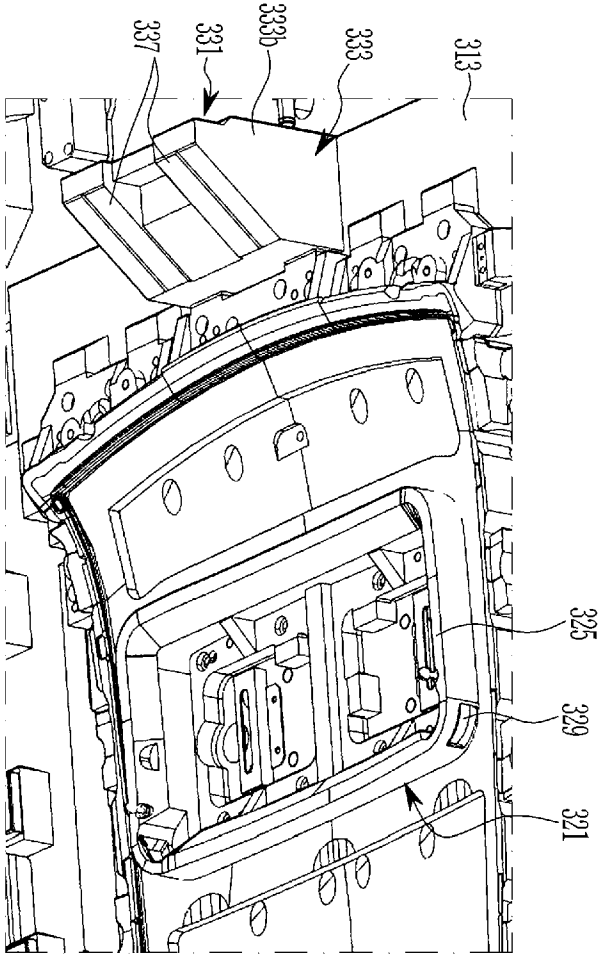

The flange forming unit 321 includes a lower flange forming steel 323 and an upper flange forming steel 325 as shown in FIGS. 13 to 15.

The lower flange forming steel 323 is provided on an upper portion of the third lower die 311. The third lower flange forming steel 323 is configured to support the edge portion of the sunroof hole 71 of the second processed plate 50.

Furthermore, the lower flange forming steel 323 includes separating blocks 327 respectively disposed on both sides in the left and right direction thereof. The separating blocks 327 may be provided as portions partially separated from the lower flange forming steel 323.

The upper flange forming steel 325 is provided on a lower portion of the third upper die 313 in correspondence to the lower flange forming steel 323. The upper flange forming steel 325 is configured to flange form (e.g., down flange) the edge portion of the sunroof hole 71 placed on the lower flange forming steel 323.

Here, through holes 329 are formed in both corners of the rear of the upper flange forming steel 325, and a second undercut forming groove 328 connected to the through holes 329 is formed in each of the separating blocks 327.

Referring to FIGS. 13 to 15, in various exemplary embodiments of the present disclosure, the second cam forming unit 331 is configured to form a second undercut face 85 as shown in FIG. 2 and FIG. 3 on at least one corner of the down flange 73 formed by the flange forming unit 321 in a cam forming method. The second cam forming unit 331 is provided on the third lower die 311 and the third upper die 313.

The second cam forming unit 331 includes a second cam slide 332 and first cam drives 333.

The second cam slide 332 is slidably provided on an upper portion of the third lower die 311 in a diagonal direction thereof.

A second lower cam forming steel 335 is provided on the second cam slide 332. The second lower cam forming steel 335 is configured to form the second undercut face 85 on at least one corner of the down flange 73.

Here, the second lower cam forming steel 335 includes a second undercut forming protrusion 336. The second undercut forming protrusion 336 may be combined to the second undercut forming groove 328 of the separating block 327 of the lower flange forming steel 323 through the through holes 329 of the upper flange forming steel 325.

The first cam drives 333 are configured to slide and move the second cam slide 332 in the diagonal direction thereof. The first cam drives 333 are provided on the third lower die 311 and the third upper die 313.

The first cam drives 333 include a lower drive 333*a* which is slidably provided on the upper portion of the third lower die 311 in the front and rear direction to be in cam contact with the second cam slide 332. The lower drive 333*a* includes at least one third cam face 334 formed to be inclined from the rear to the front.

Furthermore, the first cam drives 333 include an upper drive 333*b* provided (e.g., fixed) on the lower portion of the third upper die 311 to be in cam contact with the lower drive 333*a*. The upper drive 333*b* includes at least one fourth cam face 337 which is in cam contact with the at least one third cam surface 334 of the lower drive 333*a*.

Figure 16:
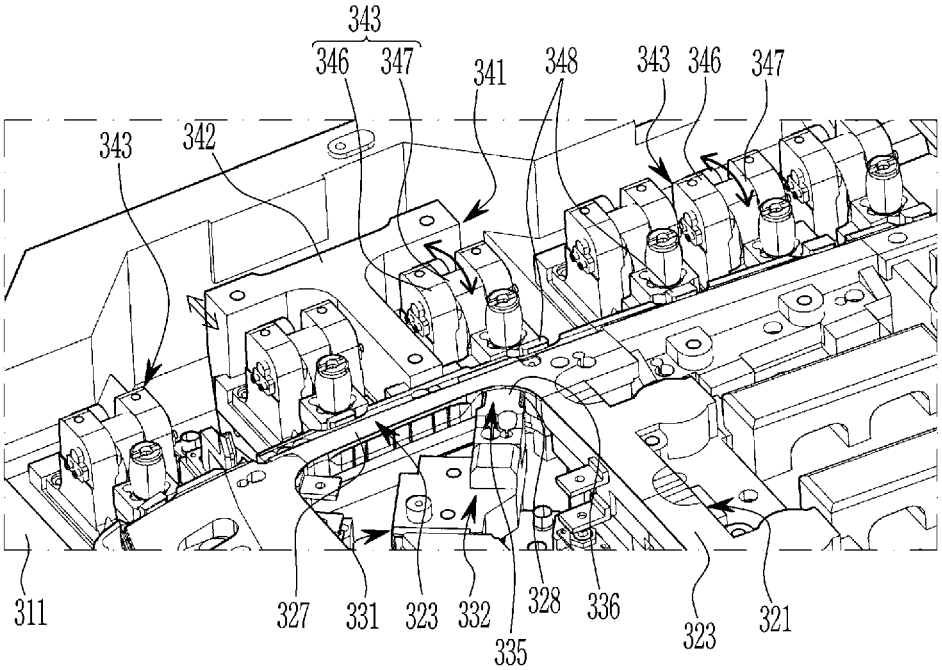
FIG. 16 and FIG. 17 are views exemplarily illustrating a third cam forming unit of a third mold applied to a manufacturing device of a roof panel for a vehicle according to various exemplary embodiments of the present disclosure.
Figure 17:
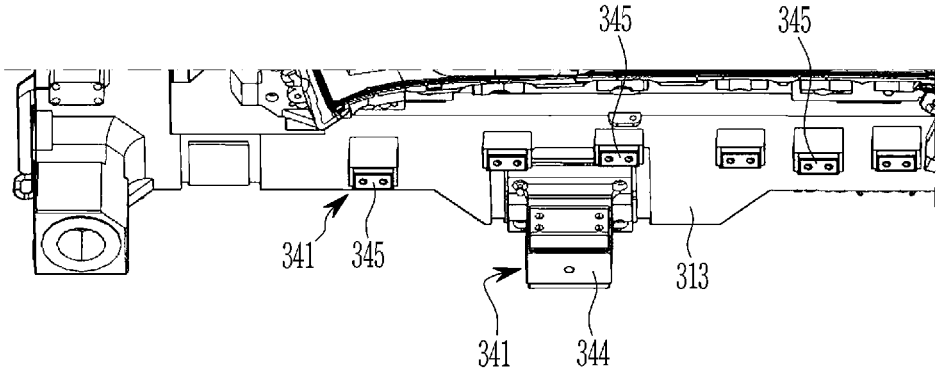

FIG. 16 and FIG. 17 are views exemplarily illustrating a third cam forming unit of a third mold applied to a manufacturing device of a roof panel for a vehicle according to various exemplary embodiments of the present disclosure.

Referring to FIGS. 16 and 17, in various exemplary embodiments of the present disclosure, the third cam forming unit 341 is configured to form the up flange 77 as shown in FIG. 2 and FIG. 3 in a cam forming method on the at least one molding mounting portion 75 (hereinafter see FIG. 7) formed on the second processed plate 50 (hereinafter see FIG. 7). The third cam forming unit 341 is provided on the third lower die 311 and the third upper die 313.

The third cam forming unit 341 includes third cam slides 342, a plurality of seesaw cams 343, a second cam drive 344, and a plurality of third cam drives 345.

The third cam slides 342 are slidably provided on an upper portion of the third lower die 311 in the left and right direction thereof. The third cam slides 342 are disposed on both left and right sides of the third lower die 311, and are combined to the respective separating blocks 327 of the lower flange forming steel 323.

The plurality of seesaw cams 343 are fixed to both sides of the third lower die 311 in the left and right direction, and are mounted on the third cam slide 342. Each of the seesaw cams 343 includes a cam block 347 which is rotated in a seesaw type in the left and right direction in the mounting block 346.

Here, a third lower cam forming steel 348 is provided on the cam block 347. The third lower cam forming steel 348 is configured to form the up flange 77.

The second cam drive 344 is configured to slide and move the third cam slide 342. The second cam drive 344 is provided on a lower portion of the third upper die 313 to be in cam contact with the third cam slide 342.

And, the plurality of third cam drives 345 are configured to rotate the respective cam blocks 347 of the plurality of seesaw cams 343. The plurality of third cam drives 345 are provided in a lower portion of the third upper die 313 to be in cam contact with the respective cam blocks 347.

Figure 18:
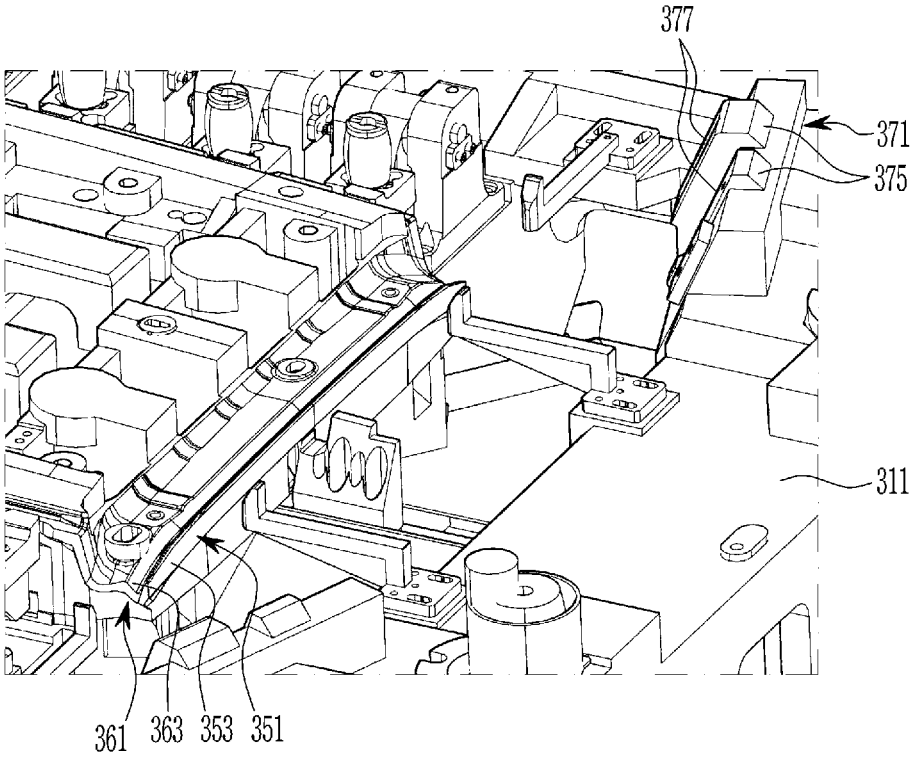
FIG. 18, FIG. 19 and FIG. 20 are views exemplarily illustrating a third forming unit, a second restriking unit, and a cam trimming unit of a third mold applied to a manufacturing device of a roof panel for a vehicle according to various exemplary embodiments of the present disclosure.
Figure 19:
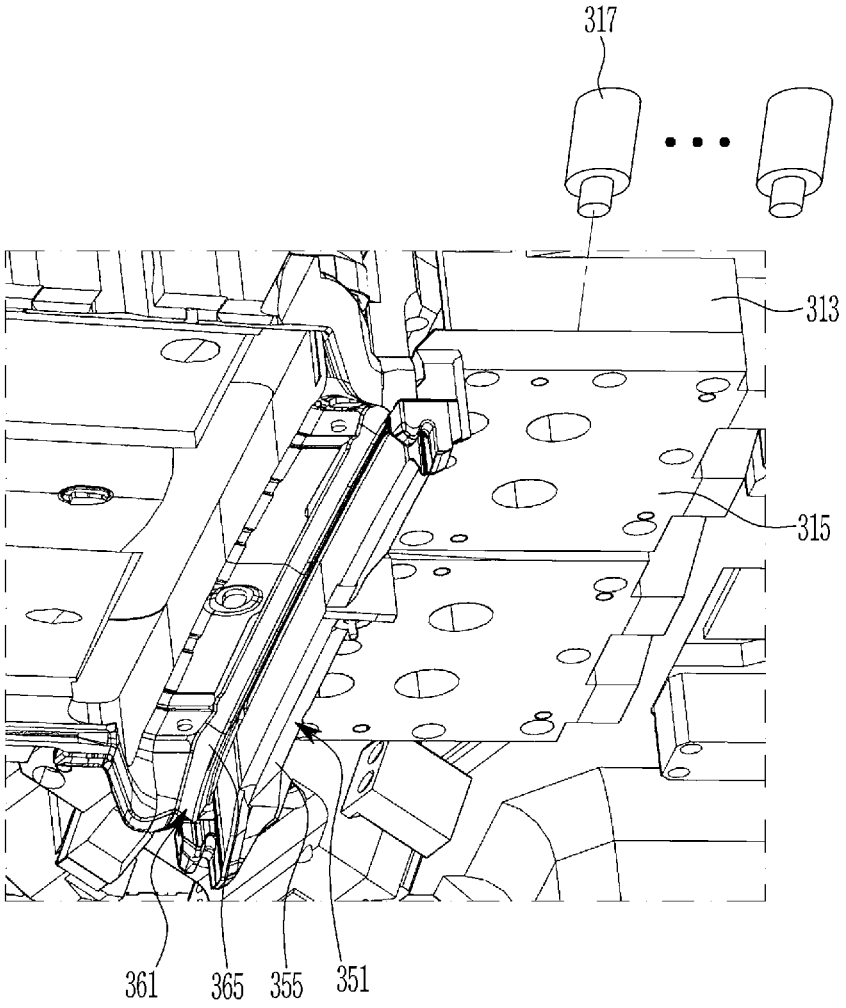
Figure 20:
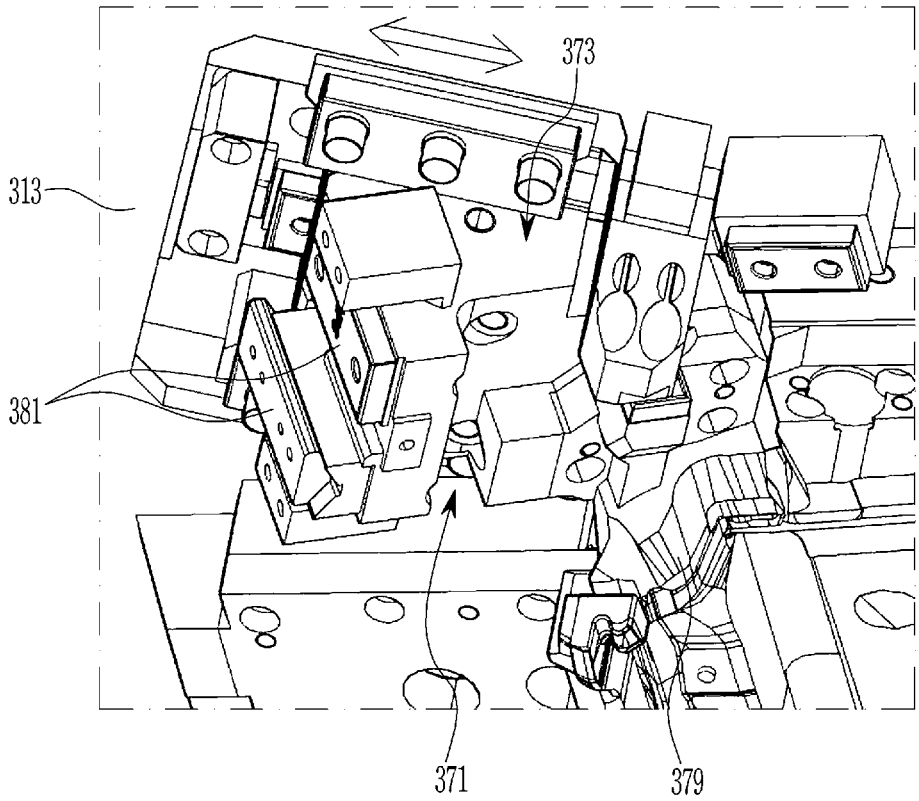

FIG. 18, FIG. 19 and FIG. 20 are views exemplarily illustrating a third forming unit, a second restriking unit, and a cam trimming unit of a third mold applied to a manufacturing device of a roof panel for a vehicle according to various exemplary embodiments of the present disclosure.

Referring to FIGS. 18 to 20, in various exemplary embodiments of the present disclosure, the third mold 310 further includes an upper pad 315 elastically supported on a lower portion of the third upper die 313.

The upper pad 315 is elastically supported on the lower portion of the third upper die 313 through a plurality of gas springs 317 and is provided to be movable in the vertical direction thereof.

In various exemplary embodiments of the present disclosure, the third trimming unit 351 is configured to trim the rear end portion (e.g., the rear edge portion) of the second processed plate 50 (hereinafter see FIG. 7). The third trimming unit 351 is provided on the third lower die 311 and the third upper die 313.

The third trimming unit 351 includes a third lower trimming steel 353 and a third upper trimming steel 355.

The third lower trimming steel 353 is provided on an upper portion of the third lower die 311. The third lower trimming steel 353 is configured to support the edge portion of the rear portion of the second processed plate 50.

The third upper trimming steel 355 is provided on a lower portion of the upper pad 315 in correspondence to the third lower trimming steel 353. The third upper trimming steel 355 is configured to cut the rear end portion of the second processed plate 50 placed on the third lower trimming steel 353.

In various exemplary embodiments of the present disclosure, the second restriking unit 361 is configured to form the water receiving portion 81 connected to the hinge mounting portion 79 as shown in FIG. 2 and FIG. 3 in the rear portion of the second processed plate 50. The second restriking unit 361 is provided on the third lower die 311 and the third upper die 313.

Here, after trimming the rear end portion of the second processed plate 50 through the third trimming unit 351, the second restriking unit 361 may form the water receiving portion 81.

The second restriking unit 361 includes a second lower restriking steel 363 and a second upper restriking steel 365.

The second lower restriking steel 363 is provided on the third lower die 311. The second lower restriking steel 363 is connected to the third lower trimming steel 353 of the third trimming unit 351. The second lower restriking steel 363 is configured to support the rear portion of the second processed plate 50.

The second upper restriking steel 365 is connected to the third upper trimming steel 355 of the third trimming unit 351. The second upper restriking steel 365 is provided on a lower portion of the upper pad 315 with a height difference from the third upper trimming steel 355 in correspondence to the second lower restriking steel 363. Here, the second upper restriking steel 365 may be disposed at a higher position than that of the third upper trimming steel 355.

In various exemplary embodiments of the present disclosure, the pair of cam trimming units 371 are configured to respectively trim both sides of the rear end portion of the second processed plate 50 in a cam trimming method. The pair of cam trimming units 371 are provided on the third lower die 311 and the third upper die 313.

Here, the pair of cam trimming units 371 may respectively trim both sides of the rear end portion of the second processed plate 50 after forming the water receiving portion 81 through the second restriking unit 361.

Each of the pair of cam trimming units 371 includes a fourth cam slide 373 and a fourth cam drive 375

The fourth cam slide 373 is slidably provided on a lower portion of the third upper die 313 in the front and rear direction thereof. The fourth cam slide 373 includes at least one fifth cam face 377 formed to be inclined from the front to the rear.

Furthermore, a cam trimming steel 379 is provided on the fourth cam slide 373. The cam trimming steel 379 is configured to cut both sides of the rear end portion of the second processed plate 50.

The fourth cam drive 375 is configured to slide and move the fourth cam slide 373. The fourth cam drive 375 is provided on an upper portion of the third lower die 311.

The fourth cam drive 375 includes at least one sixth cam face 381 which is in cam contact with the at least one fifth cam face 377 of the fourth cam slide 373.

Hereinafter, the operation of the manufacturing device 100 of the roof panel for the vehicle according to various exemplary embodiments of the present disclosure configured as described above will be described in detail with reference to FIGS. 1 to 20.

First, in a state in which the first upper die 117 of the first mold 110 is moved in the upward direction, the blank 10 is loaded onto the blank holder 113 and the lower drawing steel 115 of the first lower die 111.

In the present state, when the first upper die 117 moves in the downward direction, the blank holder 113 supports the edge portion of the blank 10 and moves in the downward direction by the first upper die 117. Accordingly, the upper drawing steel 119 of the first upper die 117 presses the blank 10.

Accordingly, the first mold 110 draws the blank 10 into a predetermined shape by the blank holder 113, the lower drawing steel 115, and the upper drawing steel 119.

Next, in a state in which the second upper die 231 of the second mold 210 is moved in the upward direction, the first processed plate 30 processed by the first mold 110 is loaded onto the second lower die 211.

In the present state, when the second upper die 231 moves in the downward direction, the first lower trimming steel 223 and the first upper trimming steel 225 of the first trimming unit 221 entirely trim the edge portion of the front portion of the first processed plate 30 and both sides thereof in the left and right direction thereof.

Here, the first lower trimming steel 223 and the first upper trimming steel 225 trim both edge portions of the first processed plate 30 in the left and right direction, and form the at least one molding mounting portion 75 on each of both edge portions.

In the present process, the second lower trimming steel 243 and the second upper trimming steel 245 of the second trimming unit 241 trim the sunroof hole 71 in the front portion of the first processed plate 30.

In this regard, the second upper trimming steel 245 may trim the sunroof hole 71 while first pressing the first processed plate 30 through the pressing protrusion 247. Accordingly, the second trimming unit 241 may minimize the occurrence of a burr formed on the edge portion of the sunroof hole 71 by the aerial trimming of the second upper trimming steel 245.

Simultaneously, the first lower restriking steels 263 and the first upper restriking steels 265 of the first restriking unit 261 respectively form the first undercut faces 83 on both edge portions of the sunroof hole 71 in the left and right direction thereof.

Here, the first undercut faces 83 may be formed while the first undercut forming protrusions 269 of the first upper restriking steels 265 are combined to the first undercut forming grooves 267 of the first lower restriking steels 263.

In the present process, the swing cam 283 and the first cam slide 289 of the first cam forming units 281 form the hinge mounting portion 79 on the rear portion of the first processed plate 30 in a cam forming method.

In the above process, in a state in which the operation rod 288 is moved forward by operation of the driving cylinder 285, the support block 287 supports the lower portion of the front side of the swing cam 283. Accordingly, the swing cam 283 is maintained in a horizontal state by the support block 287.

Accordingly, the first cam slide 289 in cam contact with the swing cam 283 slides and moves, and the first lower cam forming steel 286 of the swing cam 283 and the upper cam forming steel 297 of the first cam slide 289 may form the hinge mounting portion 79.

Here, as the first cam slide 289 in cam contact with the swing cam 283 forms the hinge mounting portion 79 from the rear side as described above, the second mold 210 may smoothly exhaust a scrap cut by the first trimming unit 221.

Furthermore, after completing a trimming process, a restriking process, and a cam forming process of the first processed plate 30 as described above, when the second upper die 231 moves in the upward direction, the operation rod 288 moves backward by operation of the driving cylinder 285, and accordingly, the support block 287 moves backward thereof.

Accordingly, the swing cam 283 rotates forward with respect to an eccentric point 282 via the rotation center shaft 293. Accordingly, the swing cam 283 may smoothly eject the second processed plate 50 on which the processing of the first processed plate 30 is completed while avoiding the interference of the hinge mounting portion 79.

Next, in a state in which the third upper die 313 of the third mold 310 is moved in the upward direction, the second processed plate 50 processed by the second mold 210 is loaded onto the third lower die 311.

In the present state, when the third upper die 313 moves in the downward direction, the lower flange forming steel 323 and the upper flange forming steel 325 of the flange forming unit 321 form the down flange 73 on the edge portion of the sunroof hole 71 of the second processed plate 50.

Simultaneously, the second cam slide 332 and the first cam drives 333 of the second cam forming unit 331 form the second undercut faces 85 on at least one corner of the down flange 73 in a cam forming method.

In the above process, while the upper drive **333*b* of the first cam drives 333 is in cam contact with the lower drive 333*a*, the lower drive 333*a* slides backward thereof. Accordingly, the second cam slide 332 in cam contact with the lower drive 333*a*** slides and moves (e.g., moves forward) in a diagonal direction thereof.

Accordingly, the second lower cam forming steel 335 of the second cam slide 332 is combined to the second undercut forming groove 328 of the separating block 327 of the lower flange forming steel 323 through the through hole 329 of the upper flange forming steel 325.

Accordingly, the second lower cam forming steel 335 may form the second undercut faces 85 at the at least one corner of the down flange 73 through the second undercut forming protrusion 336.

In the present process, the third cam slide 342, the plurality of seesaw cams 343, the second cam drive 344, and the plurality of third cam drives 345 of the third cam forming unit 341 form the up flange 77 on the at least one molding mounting portion 75 in a cam forming method.

In the above process, the second cam drive 344 is in cam contact with the third cam slide 342, the third cam slide 342 slides and moves, and each of the separating blocks 327 of the lower flange forming steel 323 is in a forward moved state.

In the present state, each of the third cam drives 345 in cam contact with the cam block 347 of each of the seesaw cams 343 rotates the cam block 34, and may form the up flange 77 on the at least one molding mounting portion 75 through the third lower cam forming steel 348 of the cam block 347.

Simultaneously, the third lower trimming steel 353 and the third upper trimming steel 355 of the third trimming unit 351 preferentially trim the rear end portion of the second processed plate 50.

Accordingly, the second lower restriking steel 363 and the second upper restriking steel 365 of the second restriking unit 361 form the water receiving portion 81 connected to the hinge mounting portion 79 on the rear portion of the second processed plate 50.

Next, after completing the trimming process and the restriking process as described above, the third upper die 313 continuously descends while pressing the upper pad 315 through the plurality of gas springs 317.

At the present time, the fourth cam slide 373 and the fourth cam drive 375 of the pair of cam trimming units 371 trim both rear end portions of the second processed plate in a cam trimming method.

Here, the fourth cam drive 375 is in cam contact with the fourth cam slide 373, the fourth cam slide 373 slides and moves, and the cam trimming steel 379 of the fourth cam slide 373 may trim each of both sides of the rear end portion of the second processed plate 50.

Furthermore, after completing the series of processes as described above, when the third upper die 313 moves in the upward direction, the second cam slide 332 of the second cam forming unit 331 returns to its original position thereof. That is, the second lower cam forming steel 335 of the second cam slide 332 returns to its original position (e.g., moves backward) through the through hole 329 of the upper flange forming steel 325.

Accordingly, the third cam slide 342 of the third cam forming unit 341 returns (e.g., moves backward) to its original position together with each of the separating blocks 327 of the lower flange forming steel 323.

Therefore, the lower flange forming steel 323 of the flange forming unit 321 may smoothly eject the roof panel 70 of which processing has been completed while avoiding the interference of the second undercut face 85 formed on the at least one corner of the down flange 73.

Unlike the related art, the manufacturing device 100 of the roof panel for the vehicle according to various exemplary embodiments of the present disclosure as described so far may manufacture the roof panel 70 of the final finished product while performing the series of processes as described above by use of the first mold 110, the second mold 210, and the third mold 310.

Therefore, the manufacturing device 100 of the roof panel for the vehicle according to various exemplary embodiments of the present disclosure may reduce the number of molds and the number of processes required for manufacturing the roof panel 70. Accordingly, the mold investment cost, the mold material cost, the processing cost, and the cost required for production management may be reduced, and the actual cost competitiveness may be improved.

Although exemplary embodiments of the present disclosure have been described above, the present disclosure is not limited thereto, and it is obvious that various modifications may be made within the scope of the claims, the detailed description of the invention, and the accompanying drawings and that also fall within the scope of the present disclosure.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The term "and/or" may include a combination of a plurality of related listed items or any of a plurality of related listed items. For example, "A and/or B" includes all three cases such as "A", "B", and "A and B".

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A manufacturing apparatus of a roof panel for a vehicle, the manufacturing apparatus comprising:

a first mold in which a blank holder and a lower drawing steel are provided in a first lower die, and an upper drawing steel corresponding to the lower drawing steel is provided in a first upper die, to draw a blank in a predetermined shape;

a second mold including first trimming units provided in a second lower die and a second upper die to trim an edge portion of a first processed plate processed by the first mold, second trimming units provided on the second lower die and the second upper die to trim a sunroof hole in a front portion of the first processed plate, first restriking units provided on the second lower die and the second upper die to form first undercut faces on first and second edge portions of the sunroof hole in a left and right direction, and first cam forming units provided on the second lower die and the second upper die to form a hinge mounting portion on a rear portion of the first processed plate; and a third mold including flange forming units provided in a third lower die and a third upper die to form a down flange on an edge portion of the sunroof hole of a second processed plate processed by the second mold, and second restriking units provided in the third lower die and the third upper die to form a water receiving portion connected to the hinge mounting portion on a rear portion of the second processed plate.

2. The manufacturing apparatus of claim 1, wherein the first trimming units form at least one molding mounting portion on each of first and second edge portions of the first processed plate in the left and right direction.

3. The manufacturing apparatus of claim 1, wherein the third mold further includes:

third trimming units provided on the third lower die and the third upper die to trim a rear end portion of the second processed plate; and a pair of cam trimming units provided on the third lower die and the third upper die to trim first and second sides of the rear end portion of the second processed plate, respectively.

4. The manufacturing apparatus of claim 3, wherein the third mold trims the rear end portion of the second processed plate through the third trimming units before forming the water receiving portion through the second restriking units, and wherein the third mold trims first and second sides of the rear end portion of the second processed plate, respectively, through the pair of cam trimming units after forming the water receiving portion through the second restriking units.

5. The manufacturing apparatus of claim 3, wherein the third mold further includes second cam forming units provided on the third lower die and the third upper die to form a second undercut face on at least one corner of the down flange.

6. The manufacturing apparatus of claim 5, wherein the first trimming unit forms at least one molding mounting portion on each of first and second edge portions of the first processed plate in the left and right direction, and wherein the third mold further includes third cam forming units provided on the third lower die and the third upper die, to form an up flange on the at least one molding mounting portion formed on the second processed plate.

7. The manufacturing apparatus of claim 6, wherein the flange forming units include:

a lower flange forming steel including separating blocks respectively disposed on first and second sides thereof in the left and right directions, and provided on the third lower die; and an upper flange forming steel provided in the third upper die in correspondence to the lower flange forming steel, and including through holes formed in first and second corners of the rear thereof.

8. The manufacturing apparatus of claim 7, wherein each of the separating blocks includes a second undercut forming groove connected to each of the through holes.

9. The manufacturing apparatus of claim 8, wherein the second cam forming units include:

a second cam slide including a second lower cam forming steel including second undercut forming protrusions combined to the second undercut forming grooves through the through holes, the second cam slide being slidably provided on the third lower die; and first cam drives provided on the third lower die and the third upper die to slide and move the second cam slide.

10. The manufacturing apparatus of claim 7, wherein the third cam forming units include:

a third cam slide combined to each of the separating blocks and slidably provided on the third lower die;

a plurality of seesaw cams fixed to first and second sides of the third lower die in the left and right direction, mounted on the third cam slide, and each including a third lower cam forming steel provided thereon;

a second cam drive provided on the third upper die to be in cam contact with the third cam slide; and a plurality of third cam drives provided on the third upper die to be in cam contact with each of the seesaw cams.

11. The manufacturing apparatus of claim 3, wherein the third mold further includes an upper pad movably provided on the third upper die in a vertical direction through a plurality of gas springs.

12. The manufacturing apparatus of claim 11, wherein the third trimming unit includes:

a third lower trimming steel provided on the third lower die; and a third upper trimming steel provided on the upper pad in correspondence to the third lower trimming steel.

13. The manufacturing apparatus of claim 12, wherein the second restriking units include:

a second lower restriking steel connected to the third lower trimming steel; and a second upper restriking steel provided on the upper pad with a height difference from the third upper trimming steel.

14. The manufacturing apparatus of claim 11, wherein each of the pair of cam trimming units includes:

a fourth cam slide slidably provided on the third upper die and including a cam trimming steel provided thereon; and a fourth cam drive provided on the third lower die to be in cam contact with the fourth cam slide.

15. The manufacturing apparatus of claim 1, wherein the first trimming units include:

a first lower trimming steel provided on the second lower die; and a first upper trimming steel provided on the second upper die in correspondence to the first lower trimming steel.

16. The manufacturing apparatus of claim 15, wherein the second trimming units include:

a second lower trimming steel connected to an internal edge portion of the first lower trimming steel; and a second upper trimming steel connected to an internal edge portion of the first upper trimming steel in correspondence to the second lower trimming steel, and including a pressing protrusion extending in a downward direction to support the first processed plate.

17. The manufacturing apparatus of claim 16, wherein the first restriking units include:

first lower restriking steels connected to the first lower trimming steel and the second lower trimming steel and including first undercut forming grooves formed therein; and first upper restriking steels connected to the first upper trimming steel and the second upper trimming steel and including first undercut forming protrusions corresponding to the first undercut forming grooves formed thereon.

18. The manufacturing apparatus of claim 1, wherein the first cam forming units include:

a swing cam rotatably provided on a die base mounted on the second lower die through a rotation center shaft in a front and rear direction and including a first lower cam forming steel mounted thereon; and a first cam slide slidably provided on the second upper die to be in cam contact with the swing cam, and including an upper cam forming steel corresponding to the first lower cam forming steel mounted thereon.

19. The manufacturing apparatus of claim 18, wherein the rotation center shaft is combined to an eccentric point biased to a rear side from a center portion of the swing cam.

20. The manufacturing apparatus of claim 19, wherein the first cam forming units further include:

a driving cylinder provided on the die base to be operable forwards and backwards in the front and rear direction thereof; and a support block combined to an operation rod of the driving cylinder to support a front side of the swing cam.

21. A manufacturing apparatus of a roof panel for a vehicle, the manufacturing apparatus including:

a first mold in which a blank holder and a lower drawing steel are provided in a first lower die, and an upper drawing steel corresponding to the lower drawing steel is provided in a first upper die, to draw a blank in a predetermined shape;

a second mold including first trimming units provided in a second lower die and a second upper die to trim an edge portion of a first processed plate processed by the first mold, second trimming units provided on the second lower die and the second upper die to trim a sunroof hole in a front portion of the first processed plate, and first restriking units provided on the second lower die and the second upper die to form first undercut faces on first and second edge portions of the sunroof hole in a left and right direction thereof; and a third mold including flange forming units provided in a third lower die and a third upper die to form a down flange on an edge portion of the sunroof hole of a second processed plate processed by the second mold.

22. A manufacturing apparatus of a roof panel for a vehicle, the manufacturing apparatus including:

a first mold in which a blank holder and a lower drawing steel are provided in a first lower die, and an upper drawing steel corresponding to the lower drawing steel is provided in a first upper die, to draw a blank in a predetermined shape;

a second mold including first trimming units provided in a second lower die and a second upper die to trim an edge portion of a first processed plate processed by the first mold, and first cam forming units provided on the second lower die and the second upper die to form a hinge mounting portion on a rear portion of the first processed plate; and a third mold including second restriking units provided in the third lower die and the third upper die to form a water receiving portion connected to the hinge mounting portion on a rear portion of a second processed plate processed by the second mold.

* * * * *